US006301839B1

(12) United States Patent
Chapman

(10) Patent No.: US 6,301,839 B1
(45) Date of Patent: Oct. 16, 2001

(54) SLED SHED

(76) Inventor: Edwin Brent Chapman, 22 Farchant Way, Vernon (CA), V1H 1E3

( * ) Notice: Subject to any disclaimer, the term of this patent is extended or adjusted under 35 U.S.C. 154(b) by 0 days.

(21) Appl. No.: 09/500,981

(22) Filed: Jun. 19, 2000

(30) Foreign Application Priority Data

Dec. 20, 1999 (CA) ..... 2292875

(51) Int. Cl.[7] ..... E04H 6/04; E04H 6/42

(52) U.S. Cl. ..... 52/79.5; 52/69; 52/64; 52/264; 52/143

(58) Field of Search ..... 52/79.5, 79.9, 52/64, 69, 264, 143, 271; 220/529, 503, 525, 573

(56) References Cited

U.S. PATENT DOCUMENTS 1,404,632 * 1/1922 Morgan .
3,667,172 6/1972 Erickson .
3,797,643 * 3/1974 Shupp ..... 206/1
5,265,385 11/1993 Smith .
6,012,253 1/2000 Burns .

* cited by examiner

*Primary Examiner*—Carl D. Friedman
*Assistant Examiner*—Patrick J. Chavez
(74) *Attorney, Agent, or Firm*—Antony C. Edwards

(57) ABSTRACT

The shed for a snowmobile or ATV of the present invention includes a rectangular container having opposed rigid planar side walls of generally equal size in parallel spaced apart array, a rigid first end wall mounted to first ends of the side walls, and an opposite second end wall pivotally mounted to opposite second ends of the side walls so as to form a door for the container. A pair of opposed facing, substantially vertical, first arrays of apertures are formed in the side walls, adjacent the first ends of the side walls, one of the first arrays in each of the side walls. Similarly, a pair of opposed facing, substantially vertical, second arrays of apertures are formed in the side walls, adjacent the second ends of the side walls, one of the second arrays in each of the side walls.

13 Claims, 9 Drawing Sheets

SLED SHED

FIELD OF THE INVENTION

This invention relates to the field of containers for personal recreation vehicles such as snowmobiles or ATVs, and in particular, to a container wherein the lid may be positioned horizontally at various elevations or inclined for use as a ramp at various inclinations within the box of the container.

SUMMARY OF THE INVENTION

In summary, the shed for a snowmobile or ATV of the present invention includes a rectangular container having opposed rigid planar side walls of generally equal size in parallel spaced apart array, a rigid first end wall mounted to first ends of the side walls, and an opposite second end wall pivotally mounted to opposite second ends of the side walls so as to form a door for the container. A pair of opposed facing, substantially vertical, first arrays of apertures are formed in the side walls, adjacent the first ends of the side walls, one of the first arrays in each of the side walls. Similarly, a pair of opposed facing, substantially vertical, second arrays of apertures are formed in the side walls, adjacent the second ends of the side walls, one of the second arrays in each of the side walls.

The apertures in the first arrays are substantially equal in elevation between corresponding apertures on each of the side walls. They are also equal in elevation relative to corresponding apertures in the second arrays so that an uppermost set of four uppermost apertures consisting of an uppermost opposed facing pair of the apertures in the first arrays and an uppermost opposed facing pair of the apertures in the second arrays lie in a corresponding uppermost horizontal plane. Lower sets of four apertures corresponding vertically with, and parallel to, the set of four uppermost apertures define a parallel vertically spaced apart array of horizontal planes wherein the uppermost horizontal plane is an uppermost plane of the array of horizontal planes.

A first rod is insertable through horizontally opposite apertures in the first arrays of apertures. A second rod is insertable through horizontally opposite apertures in the second arrays of apertures.

A rigid planar lid is mountable onto the first and second rods when the first and second rods are journalled through the horizontally opposite apertures in the first and second arrays of apertures respectively. The lid is sized so as to fit between the side walls and the end walls of the container.

When the horizontally opposite apertures correspond to the set of four uppermost apertures, or to one of the lower sets of four apertures, then the lid is horizontal when mounted onto the first and second rods so as to provide a platform. The platform may correspond in height to a truck tailgate for loading and unloading of the snowmobile or ATV respectively onto, or from, the tailgate. The platform may also provide a lid over the snowmobile or ATV when the snowmobile or ATV is stored within the container on a floor of the container.

When the horizontally opposite apertures in the first arrays of apertures are vertically offset relative to the horizontally opposite apertures in the second arrays of apertures, the lid when mounted on the first and second rods forms a ramp extending substantially from the first end wall to the second end wall.

In one embodiment, the floor is a planar rigid platform member mounted on a further pair of rods journalled through lowermost horizontally opposite apertures in the first and second arrays of apertures.

Advantageously, the apertures in the first arrays of apertures are equally spaced apart and the apertures in the second arrays of apertures are equally spaced apart. The first and second arrays of apertures may be spaced apart by approximately 5 inches.

Further advantageously, the container is mounted on wheels.

Strap mounts may be mounted to the outside of the container. The strap mounts are for mounting of straps thereto so as to secure the first ends of the side walls against the tailgate of the truck when the tailgate is lowered. The strap mounts may be a first pair of securing means for tying looped ends of the straps thereto. The first pair of securing means are oppositely disposed on the side walls of the container. A second pair of securing means may also be mountable to the side walls. The first and second pairs of securing means may be pairs of hooks.

The first and second rods are lockably mountable when journalled in the horizontally opposite apertures by releasable locking means mountable onto opposite ends of the rods. The releasable locking means may be cotter pins mountable through corresponding holes in the opposite ends of the rods. Advantageously, a second the container may be stacked on top of a first container. Further advantageously, the container includes bolt engaging means so that the container may be bolted to the frame of a trailer when the container is mounted on the trailer.

DETAILED DESCRIPTION OF PREFERRED EMBODIMENTS

The sled shed is made out of high density polyethylene which is very strong and light weight. As seen in FIGS. 1 and 1*a*–1*e*, the sled shed has three solid sides and a solid floor. The height of the three solid sides is 51.5 inches. The sled shed is 50.5 inches wide. The length of the sled shed is 125.5 inches. The fourth side of the sled shed has a door which is hinged from the solid side. The door is the same size as the front solid side (50.5"×51.5"). The roof or lid sits inside the box. It is 1.75 inches thick and just slightly smaller than the three solid sides and door.

Two steel rods run straight through holes in the sides. A cotter pin keeps them from sliding out of the holes. The holes are set for different heights, roughly 5 inches apart. When rods are put through the holes in the sides and secured with cotter pins, the roof or lid slides down inside the box to rest on the rods. At the top of the front and back of the shed are four hooks so that a rope or strap or the like (collectively referred to as straps) can be hooked to the hooks to secure the shed when loading or unloading snowmobiles or ATVs, or when lifting the boxes to stack them.

Figure 1:
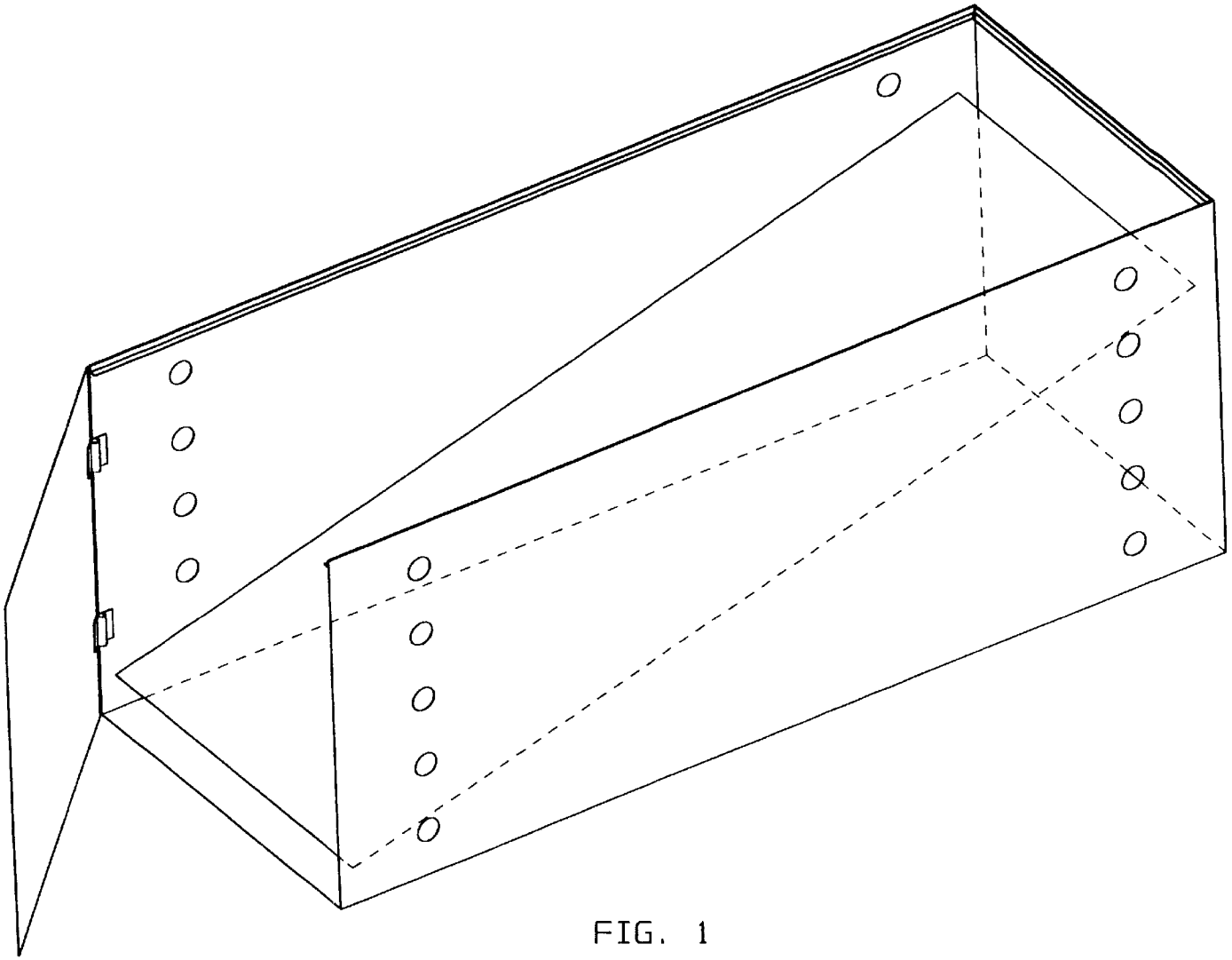
FIG. 1 is, in perspective view, the sled shed of the present invention.
Figure 1A:
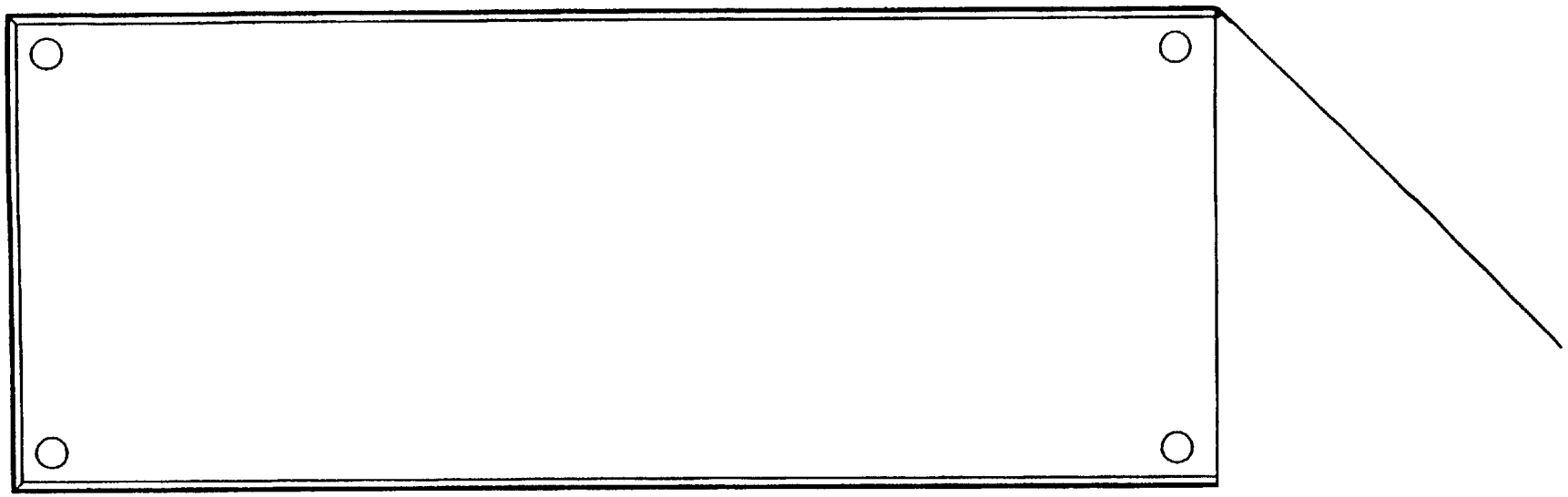
FIG. 1*a* is, in plan view, the sled shed of FIG. 1.
Figure 1B:
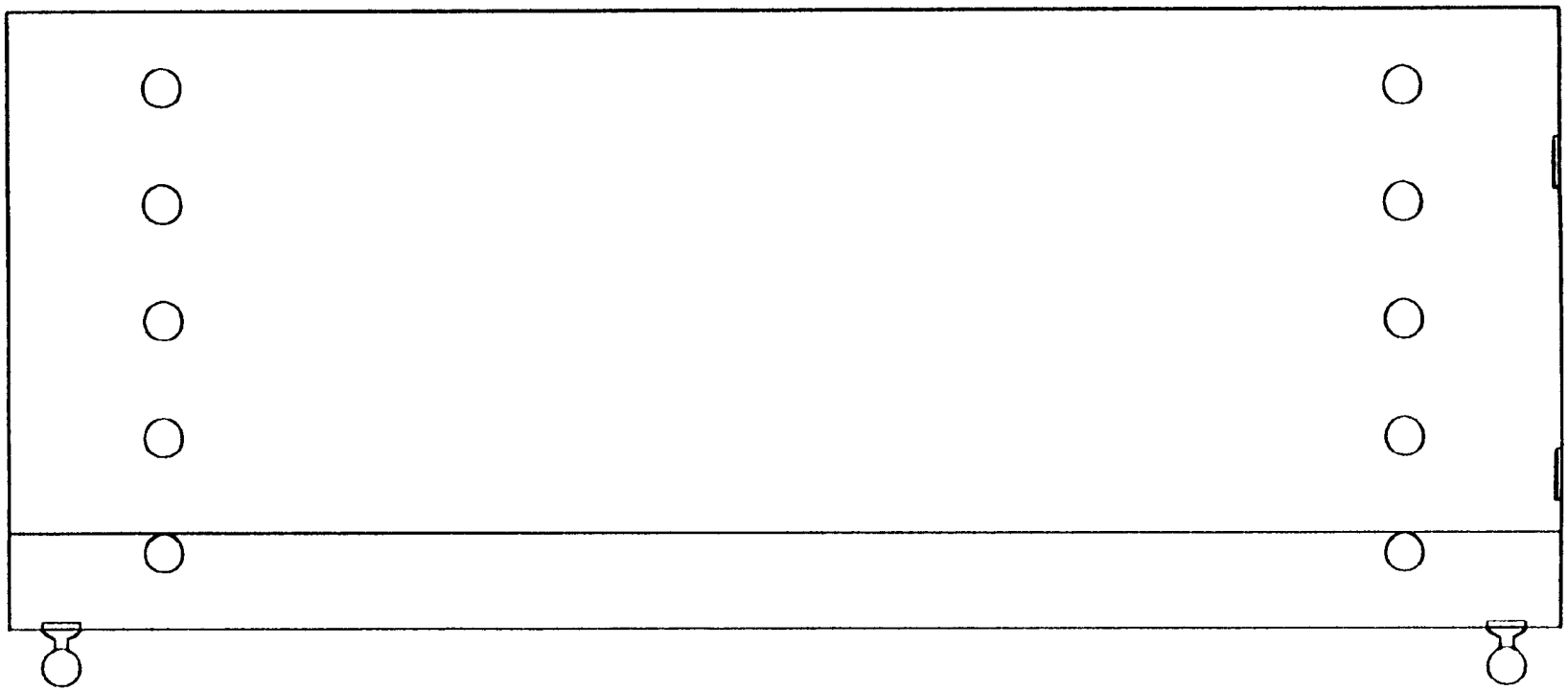
FIG. 1*b* is, in side elevation view, the sled shed of FIG. 1*a*.
Figure 1C:
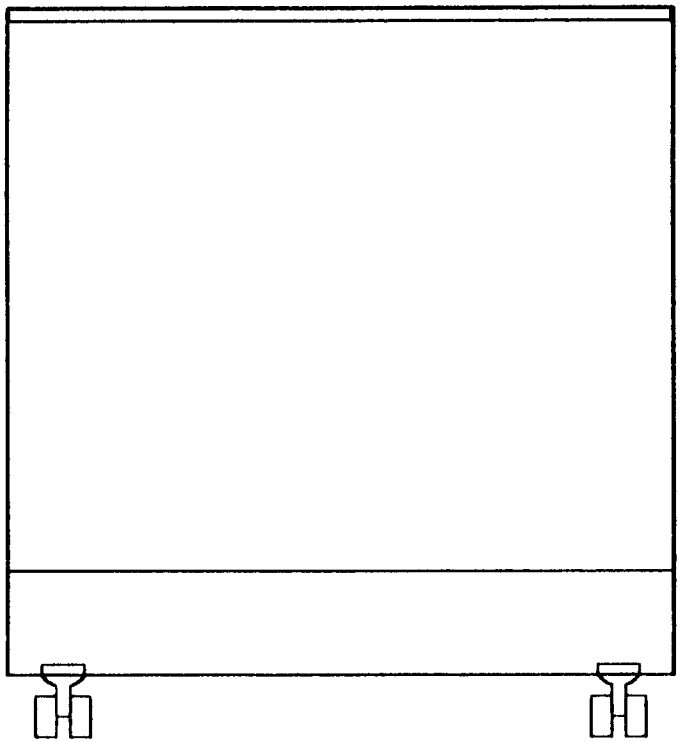
FIG. 1*c* is, in end elevation view, the sled shed of FIG. 1*a*.
Figure 2A:
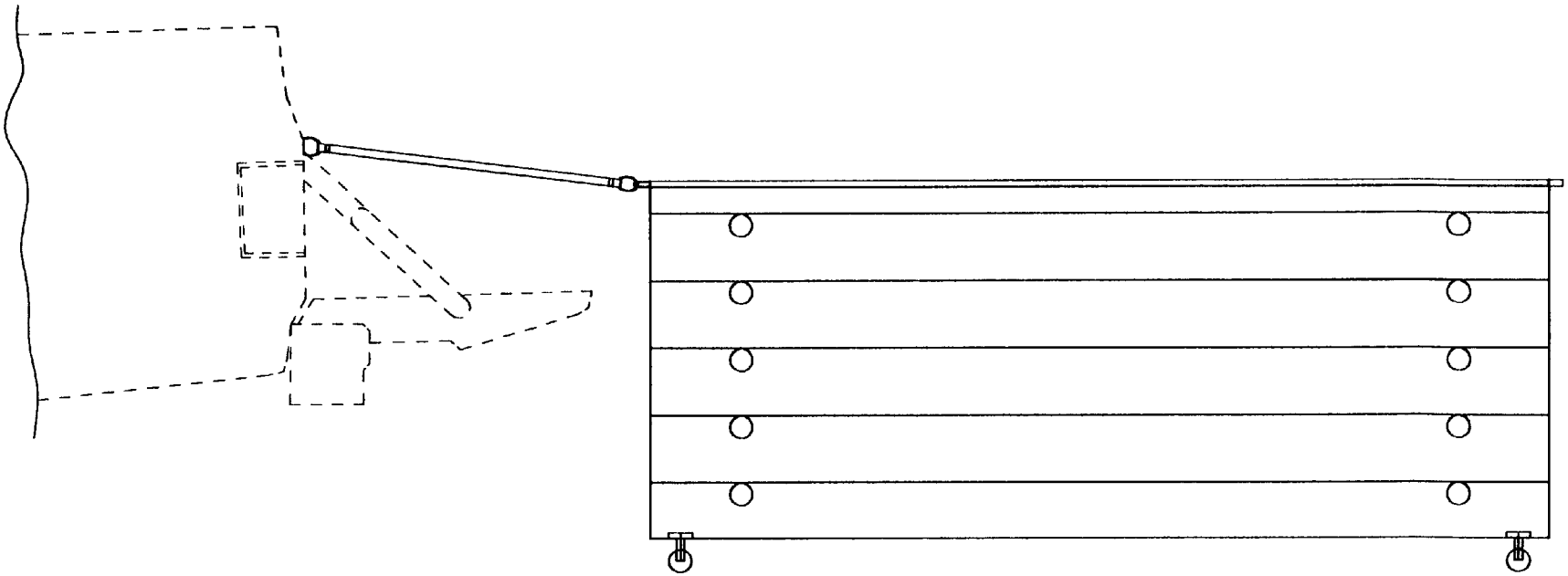
FIG. 2*a* is, in side elevation view, the sled shed of FIG. 1 showing the lid platform positioned horizontally at various elevations, and the sled shed strapped to the rear of a truck with its tailgate open.
Figure 2B:
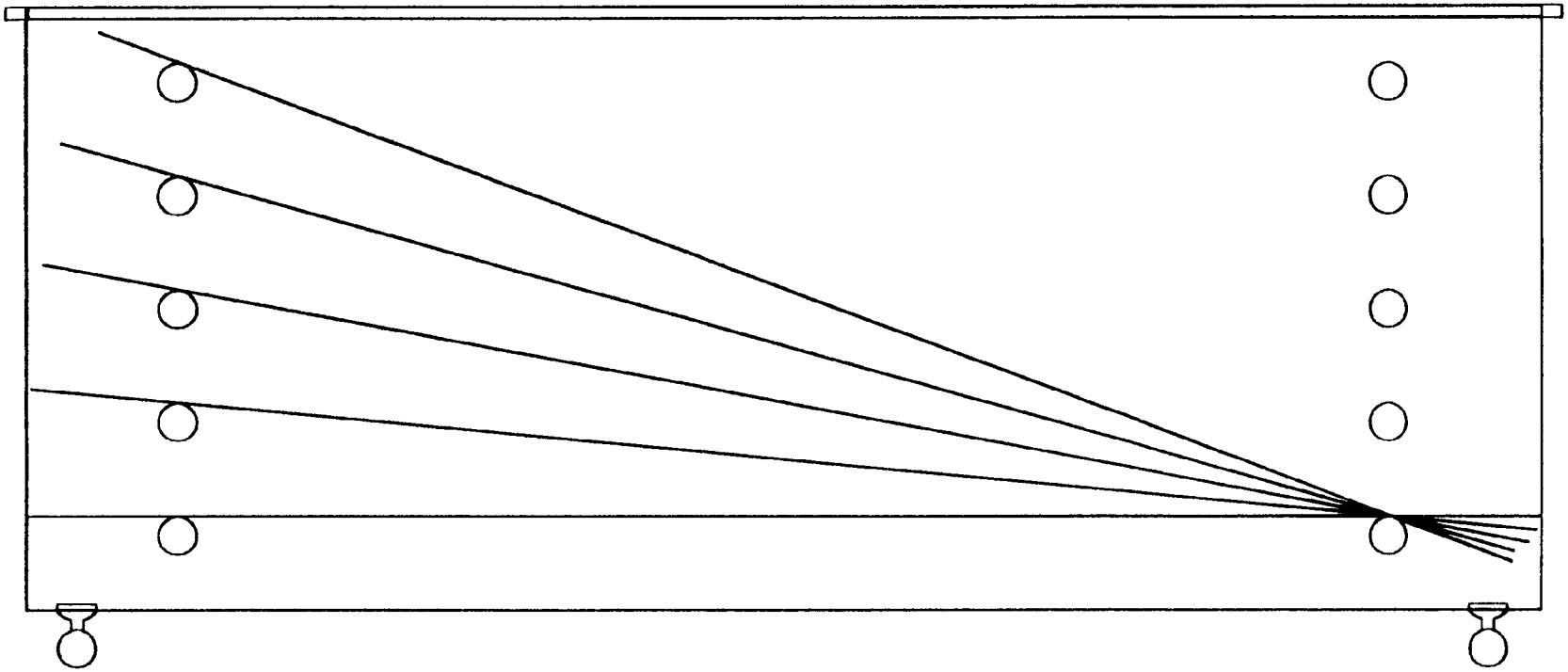
FIG. 2*b* is, in side elevation view, the sled shed of FIG. 2*a* with the lid platform inclined at various angles so as to form a ramp.
Figure 3:
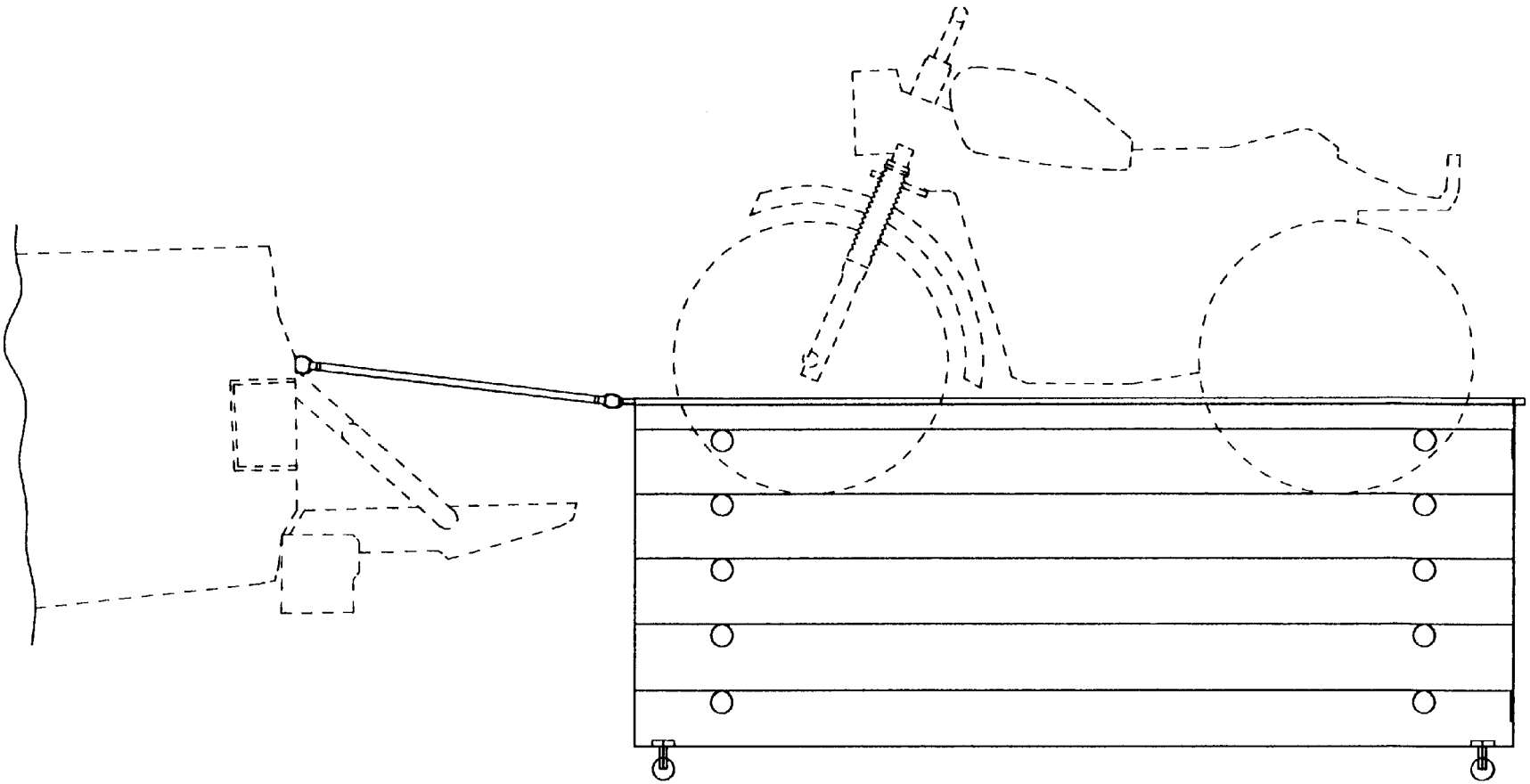
FIG. 3 is, in side elevation view, the sled shed of FIG. 2*a* with an ATV parked on a horizontal lid platform at an elevation oriented for loading of the ATV onto the truck.
Figure 4A:
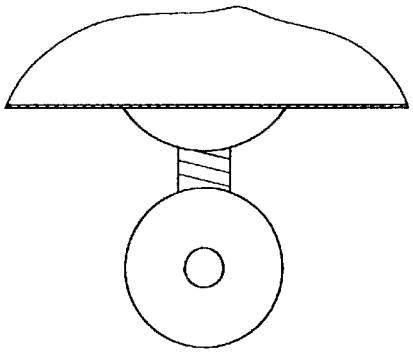
FIG. 4*a* is, in enlarged side elevation view, a wheel mounted to the bottom of the sled shed box.
Figure 4B:
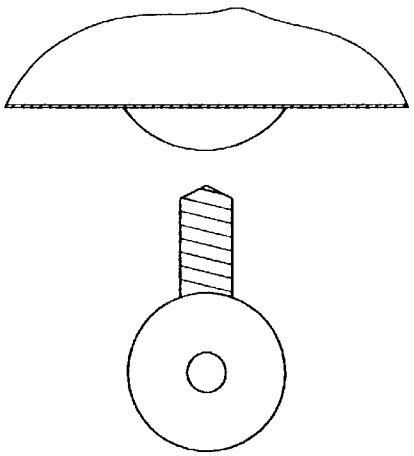
FIG. 4*b* is, in exploded view, the wheel of FIG. 4*a*.

FIG. 2*a* shows a tailgate at the back of a pickup truck. Straps hold the sled shed in place behind the tailgate. When the snowmobile or ATV is in the back of the truck or on top of sled shed, the snowmobile or ATV can easily be loaded or unloaded once the rods have been adjusted to the proper tailgate height, on the lid which is inclined to form a ramp as seen in FIG. 2*b*. Because most trucks have different tailgate heights, the rod adjustment is very important. Once the ATV such as seen in FIG. 3 or snowmobile is on top of the sled shed it can easily be moved around on wheels, better seen in FIGS. 4*a* and 4*b*, mounted to the bottom of the box. The sled shed can be used as a ramp when you remove the back rod and keep the front rod at the desired height (i.e., of the tailgate). The snowmobile can be driven into the shed and held there with the brake of the snowmobile or a strap from the two hooks on the front of the shed. Because most of the weight is at the front of a snowmobile the back end can be lifted manually and the back rod can be placed through the desired hole (i.e., to level).

Figure 5:
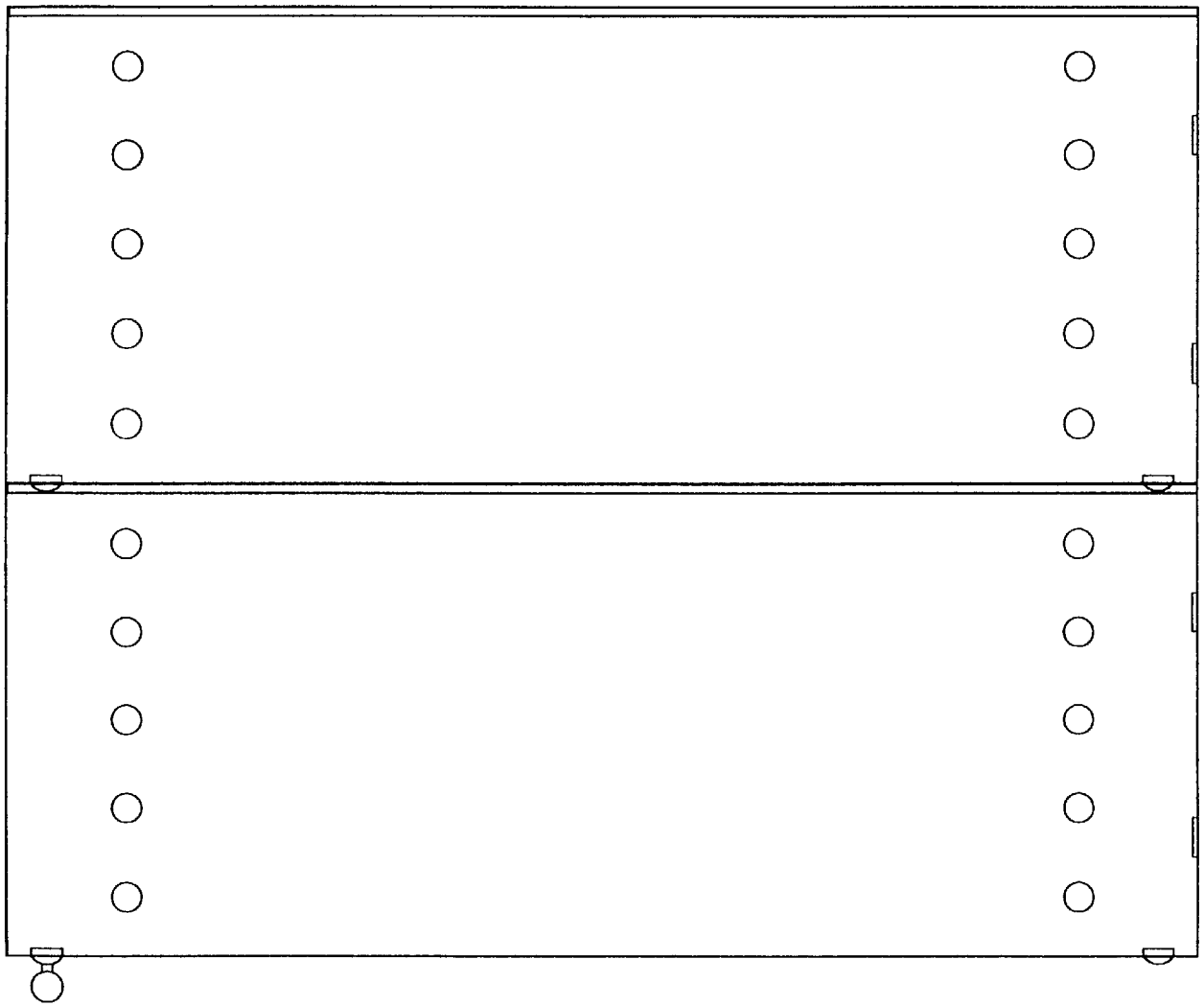
FIG. 5 is, in side elevation view, two sled sheds of the present invention stacked one upon the other.

When finished with the ATV or snowmobile for the season the lid or roof may be adjusted to the highest hole and the snowmobile or ATV can be driven inside and door closed. Another snowmobile or ATV can be placed on top to reduce space or if person has two sled sheds they can be stacked on top of each other as seen in FIG. 5. Dealers would find these very useful because: (a) they could use the sled shed for displaying their ATVs and snowmobiles on the sales floor, and (b) they can be moved with ease.

When you are using your ATV or snowmobile and it is on the top of shed then gas cans, oil and any other equipment can be stored inside the shed and vise versa when ATV or snowmobile is inside the roof then becomes the storage area. When ATVs or snowmobiles are double-decked you are conserving space. Dealers would find this feature handy. With the sled shed they could stack several units on top of each other when it is off season.

As the cost for snowmobile covers have increased over the years, and the covers do become worn, the shed is made of a very strong and durable material so that it will last for many years. If a person wishes to transport the shed on a trailer he can remove the wheels and use a bolt to come from below the trailer to bolt the shed to the frame of the trailer. Thus you can use the shed as a cover to protect you snowmobile or ATV from the elements.

I know from owning my own snowmobile and ATV that when finished for the day snowmobiling or riding my ATV, upon my return home it is often very difficult to unload snowmobile or ATV to the ground. Consequently, I tend to leave my snowmobile or ATV in the back of my truck until my next trip out. By doing so I put my ATV and snowmobile at risk of being stolen out of the back of the truck. Using the sled shed a snowmobile or ATV can be loaded and unloaded easily. Thus a person will now take the extra minutes to unload using the sled shed. Once a snowmobile is on the ground it makes it very difficult to move the snowmobile unless there is snow on the ground. Often there is no snow around my home, only in the mountains. Snowmobiles have carbine skis which cut grooves in the concrete in my garage. Using my sled shed, this is eliminated. I know there are many people that live in the city like myself that would find the sled shed very useful.

In summary, there are several different ways the Sled Shed is useful; namely:

a) loading and unloading;

b) storage;

c) space saver;

d) transportation; and e) security.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A shed for a snowmobile or ATV comprising:

a rectangular container having opposed rigid planar side walls of generally equal size in parallel spaced apart array, a rigid first end wall mounted to first ends of said side walls, an opposite second end wall pivotally mounted to opposite second ends of said side walls so as to form a door for said container, a pair of opposed facing, substantially vertical, first arrays of apertures in said side walls, adjacent said first ends of said side walls, one of said first arrays in each of said side walls, a pair of opposed facing, substantially vertical, second arrays of apertures in said side walls, adjacent said second ends of said side walls, one of said second arrays in each of said side walls, wherein said apertures in said first arrays are substantially equal in elevation between corresponding said apertures on each of said side walls and equal in elevation relative to corresponding said apertures in said second arrays so that an uppermost set of four uppermost apertures consisting of an uppermost opposed facing pair of said apertures in said first arrays and an uppermost opposed facing pair of said apertures in said second arrays, lie in a corresponding uppermost horizontal plane, and wherein lower set of four apertures corresponding vertically with, and parallel to, said set of four uppermost apertures define a parallel vertically spaced apart array of horizontal planes wherein said uppermost horizontal plane is an uppermost plane of said array of horizontal planes, a first rod insertable through horizontally opposite apertures in said first arrays of apertures, a second rod insertable through horizontally opposite apertures in said second arrays of apertures, a rigid planar lid mountable onto said first and second rods when said first and second rods are journalled through said horizontally opposite apertures in said first and second arrays of apertures respectively, said lid sized so as to fit between said side walls and said end walls, wherein when said horizontally opposite apertures correspond to said set of four uppermost apertures or to one of said lower sets of four apertures, said lid is horizontal when mounted onto said first and second rods so as to provide a platform which may correspond in height to a truck tailgate for loading and unloading of said snowmobile or ATV respectively onto or from the tailgate, or so as to provide a lid over said snowmobile or ATV when said snowmobile or ATV is stored within said container on a floor of said container, and wherein when said horizontally opposite apertures in said first arrays of apertures are vertically offset relative to said horizontally opposite apertures in said second arrays of apertures, said lid when mounted on said first and second rods forms a ramp extending substantially from said first end wall to said second end wall.

2. The shed of claim 1 wherein said floor is a planar rigid platform member mounted on a further pair of rods journalled through lowermost said horizontally opposite apertures in said first and second arrays of apertures.

3. The shed of claim 1 wherein apertures in said first arrays of apertures are equally spaced apart, and wherein apertures in said second arrays of apertures are equally spaced apart.

4. The shed of claim 1 wherein said container is mounted on wheels.

5. The shed of claim 1 wherein strap mounts are mounted to the outside of said container, said strap mounts for mounting of straps thereto so as to secure said first ends of said side walls against said tailgate when said tailgate is lowered.

6. The shed of claim 5 wherein said strap mounts are a first pair of securing means for tying looped ends of said straps thereto, said first pair of securing means oppositely disposed on said side walls.

7. The shed of claim 1 wherein said first and second rods are lockably mountable when journalled in said horizontally opposite apertures by releasable locking means mountable onto opposite ends of said rods.

8. The shed of claim 1 wherein said releasable locking means are cotter pins mountable through corresponding holes in said opposite ends of said rods.

9. The shed of claim 3 wherein said apertures in said first and second arrays of apertures are spaced apart by approximately 5 inches.

10. The shed of claim 6 further comprising a second pair of securing means mountable to said side walls.

11. The shed of claim 10 wherein said first and second pairs of securing means are pair of hooks.

12. The shed of claim 1 wherein a second said container may be stacked on top of said container.

13. The shed of claim 1 wherein said container has bolt engaging means so that it may be bolted to the frame of a trailer when said container is mounted on said trailer.

* * * * *